United States Patent [19]

Evans

[11] 4,105,910

[45] Aug. 8, 1978

[54] FLUORESCENT LAMP WITH AN INTEGRAL FAIL-SAFE AND AUXILIARY-AMALGAM COMPONENT

[75] Inventor: George S. Evans, Caldwell, N.J.

[73] Assignee: Westinghouse Electric Corp., Pittsburgh, Pa.

[21] Appl. No.: 679,598

[22] Filed: Apr. 23, 1976

[51] Int. Cl.[2] ..... H01J 61/28; H01J 61/42

[52] U.S. Cl. ..... 313/490; 313/174

[58] Field of Search ..... 313/174, 490

[56] References Cited

U.S. PATENT DOCUMENTS

| | | | |
|---|---|---|---|
| 3,227,907 | 1/1966 | Bernier et al. | 313/490 X |
| 3,265,917 | 8/1966 | Ray | 313/174 X |
| 3,629,641 | 12/1971 | Hofmann et al. | 313/490 X |

FOREIGN PATENT DOCUMENTS 4,415,840 7/1969 Japan.

*Primary Examiner*—Palmer C. Demeo
*Attorney, Agent, or Firm*—D. S. Buleza

[57] ABSTRACT

Fast "warm-up" of an amalgam-regulated fluorescent lamp under "cold" starting conditions and safe failure of the lamp at the end of its useful life are achieved by coating selected portions of both stems with a material that contains indium or an indium alloy and initially is semiconductive. The coating is applied to portions of the stems adjacent the electrodes and covers a segment of one or both of the lead wires at the point where they emerge from the stem presses. The coating is thus rapidly heated and releases mercury vapor as soon as the lamp is energized. When the electrodes are devoid of emission material and the lamp has reached the end of its useful life, sputtered material from the metal parts of the mount renders the coating electrically conductive and causes the arc to impinge upon and finally puncture the stem. The coating accordingly serves both as an auxiliary-amalgam source and a "fail-safe" component. Coatings of materials that are electrically conductive as soon as applied and contain an amalgamative metal can also be used, providing they do not contact both leads.

7 Claims, 5 Drawing Figures

FLUORESCENT LAMP WITH AN INTEGRAL FAIL-SAFE AND AUXILIARY-AMALGAM COMPONENT

BACKGROUND OF THE INVENTION

1. Field of the Invention

This invention relates to electric discharge lamps and has particular reference to an improved fluorescent lamp in which the mercury-vapor pressure during operation is regulated by means of an amalgam.

2. Description of the Prior Art

Low-pressure mercury-vapor discharge lamps that contain a strategically located body of a metal such as indium, cadmium or the like which forms an amalgam with mercury and regulates the mercury-vapor pressure within the lamp during operation are well known in the art. A fluorescent lamp of this type is described in U.S. Pat. No. 3,007,071 issued Oct. 31, 1961 to A. Lompe et al. Lamps regulated in this manner inherently operate in a "mercury-starved" unstable condition at a low light-output level for a certain period of time after they are first started since the amalgam reservoir heats up slowly because of its location within the lamp. The resulting slow "warm-up" problem under cold-start conditions has been corrected by employing an auxiliary source of amalgam that is located near one of the lamp electrodes and is thus rapidly heated and quickly releases mercury vapor. Fluorescent lamps having such auxiliary sources of amalgam placed on selected parts of the stem or mount structure are described in various patents such as U.S. Pat. No. 3,227,907 issued Jan. 4, 1966 to Bernier et al and U.S. Pat. No. 3,629,641 issued Dec. 21, 1971 to Kuhl et al.

Another problem encountered in fluorescent lamps, particularly those designed for operation at high power loadings, is that the lamps sometimes do not fail in a safe manner at the end of their useful lives. This occurs when the emission material on the electrodes becomes exhausted and the arc strikes the lead wires and causes them to melt or soften sufficiently that they contact the glass bulb and cause it to crack. As a safeguard against this potential hazard, the lamps are provided with an internal "fail-safe" structure that provides an electrically-conductive path from one or both lead wires to a portion of the glass stem. At the end of the useful life of the lamp the arc discharge is accordingly directed or drawn by the fail-safe conductor means to the stem — thus cracking and puncturing the stem and rendering the lamp inoperative.

A fluorescent lamp wherein the fail-safe component comprises a wire or a coating of conductive material that is applied to the stem press and connected to one of the leads is disclosed in U.S. Pat. No. 3,265,917 issued Aug. 9, 1966 to J. G. Ray. A fluorescent lamp wherein the fail-safe conductive component comprises a strip of aluminum powder that is coated onto the stem press and contacts one of the lead wires is disclosed in Japanese Patent Publication No. 44-15840 dated July 14, 1969 of Sometani et al (applied for on May 12, 1965 by Toshiba Electric Company).

An amalgam-type fluorescent lamp wherein the dual functions of fast "warm-up" and fail-safe operation are achieved by means of a notched yoke of wire mesh or sheet metal that is "clipped" onto the stem press and carries an auxiliary source of amalgam is described in U.S. Pat. No. 3,562,571 issued Feb. 9, 1971 to Chalmers Morehead and the author of the present invention. While such metal-clip components provide the desired fast warm-up and fail-safe features, they are rather expensive from a material and lamp-manufacturing standpoint. A structure which performs both functions in the same reliable and positive manner but which is more economical would accordingly be very desirable and advantageous.

SUMMARY OF THE INVENTION

The desired objectives are achieved in accordance with the invention by coating a selected portion of each stem press with a material that contains a suitable amalgamative metal (such as indium or an indium alloy) and is preferably semi-conductive while the lamp is operating in a normal fashion and automatically is rendered electrically conductive when the lamp begins to fail. The amalgamative metal is finely divided and dispersed in a paint-like composition which is simply deposited on the stem presses and allowed to dry before the stem assemblies are sealed to the lamp envelope. The dual-purpose coating can be applied in the form of separate stripes that extend along the sealed-in portions of the lead wires or in the form of a band that is wide enough to overlie the embedded portions of both leads. In either case, the coating overlaps and contacts one or both lead wires at the point where they emerge from the stem press and is thus adapted to direct the arc to a thin-walled portion of the glass stem or simply to the stem press when the electrodes no longer are able to sustain the discharge and the coating becomes conductive.

The size or area of the coated stripes or band and the coating formulation are correlated with the operating characteristics of the particular fluorescent lamp type involved to provide the amount of amalgamative metal on the stems required to effect fast "warm-up" of the lamp under cold starting conditions. Additional powdered metals or powdered non-metallic materials (such as aluminum and aluminum oxide) may also be employed in the paint composition to improve the adherence of the dried coating to the surface of the glass stem.

BRIEF DESCRIPTION OF THE DRAWINGS

A better understanding of the invention will be obtained from the exemplary embodiments shown in the accompanying drawing, wherein.

DESCRIPTION OF THE PREFERRED EMBODIMENTS

While the present invention can be advantageously employed in various kinds of electric discharge devices that contain a vaporizable metal (such as mercury) and require some means for regulating the metal-vapor pressure within the device when the latter is energized and then insuring that the device fails in a safe manner at the end of its useful life, it is particularly adapted for use in conjunction with low-pressure type electric discharge lamps such as fluorescent lamps and it has accordingly been so illustrated and will be so described.

Figure 1:
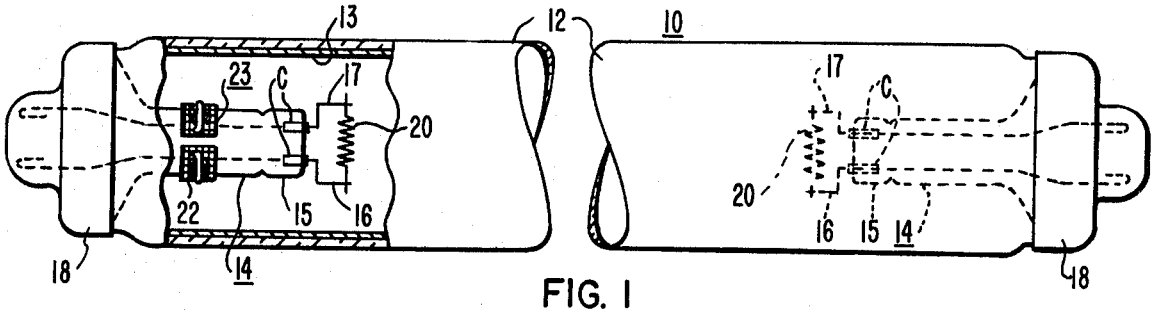
FIG. 1 is a side elevational view of a fluorescent lamp that embodies the invention, portions of the envelope being removed for illustrative purposes.

Such a lamp 10 is shown in FIG. 1 and comprises the usual tubular envelope 12 of vitreous material that is provided with an inner coating 13 of suitable ultraviolet-responsive phosphor and contains a suitable ionizable medium such as a predetermined amount of mercury and an inert fill gas that are introduced into the envelope in the customary fashion. The ends of the envelope 12 are fused to hollow glass stems 14 which extend into the envelope and provide a re-entrant wall closure at each end of the lamp 10. Suitable lead-in conductors such as a pair of lead wires 16, 17 are also provided at each end of the lamp 10 and have medial portions that are embedded in press seals 15 of fused glass that are formed on the inner ends of the glass stems 14 in accordance with standard lamp-making practice. The inner ends of each of the tubular stems 14 are thus terminated by hermetic seals and the stems define elongated cavities at each end of the sealed envelope 12 that are open to the atmosphere. The outer portions of the lead wires 16 and 17 extend through these cavities and are anchored in suitable base members 18 that are fastened to the sealed ends of the envelope 12, thus providing a pair of terminals at each end of the lamp 10.

The inner end portions of each pair of lead wires 16, 17 are fastened to a thermionic electrode such as a tungsten wire coil 20 that is coated with suitable electron-emissive material, such as the well known alkaline earth carbonates for example.

In accordance with the usual practice, the lamp 10 is dosed with a predetermined amount of mercury and a fill gas such as argon, neon, or a mixture of argon and neon at a pressure of several torr before the exhaust tubulation (not shown) is sealed off.

Figure 3:
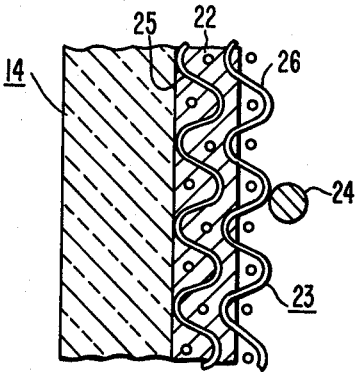
FIG. 3 is an enlarged cross-sectional view through the main amalgam component, along the line III—III of FIG. 2.

The mercury-vapor pressure within the fluorescent lamp 10 during normal or stabilized operating conditions is controlled by a main source 22 of a suitable mercury-amalgam material (such as indium, an indium-tin alloy, etc.), which is held on the tubular portion of one of the stems 14 by a wire mesh collar of the type described in U.S. Pat. No. 3,534,212 issued Oct. 13, 1970 to the author of the present invention. The main source of amalgam-forming metal 22 is thus divided into two laminar segments that are disposed within a wire mesh collar and the resulting amalgam assembly 23 is locked in place on the stem 14 by a wire ring 24. As will be noted in FIG. 3, the strips of amalgamative metal 22 (such as indium) are embedded in a wire-mesh member 25 and positioned in contact with the tubular glass stem 14, and a second piece of wire-mesh 26 is placed on top of and partly embedded in the exposed surface of the amalgamative metal 22 to form a "sandwich-like" collar assembly 23 pursuant to the teachings of the aforesaid U.S. Pat. No. 3,534,212.

As illustrated in FIG. 1, each of the stem assemblies 14 are provided with a coating C which serves both as an auxiliary source of mercury vapor under cold-starting conditions and as a fail-safe component which automatically becomes operative at the end of the useful life of the lamp 10.

Figure 2:
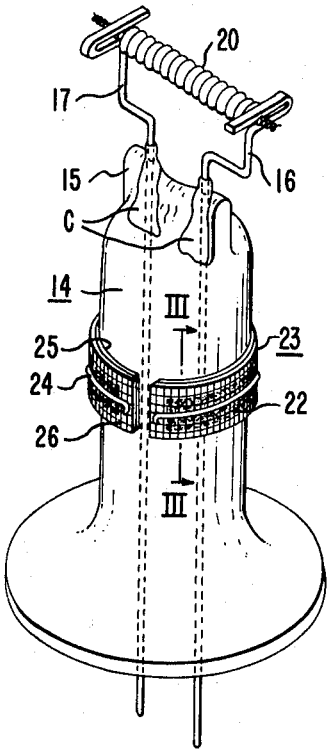
FIG. 2 is an enlarged perspective view of the stem assembly which is provided with the main source of amalgam and the dual-purpose auxiliary amalgram and fail-safe component in accordance with the present invention.

As shown more particularly in FIG. 2, the coating C is applied in the form of two stripes that are located on one of the flat faces of the pressed seal 15 of the stem 14 and are disposed in substantially aligned relationship with the medial portions of the respective lead wires 16, 17 that are embedded in the seal. As will be noted, the coated stripes C extend from the shouldered portion of the respective stems 14 at the base of the press seal 15, across the face of the seal and preferably overlap a few millimeters of the respective lead wires at the points where they emerge from the stem press. The coatings C are thus adapted to provide electrically-conductive paths from the inner end portions of the lead wires 16, 17 to embedded and exterior parts of the respective lead. When the lamp 10 begins to fail, the arc will thus impinge on the overlying portions of the stem 14. This eventually causes the glass stem to fracture and admits air into the envelope 12 which renders the lamp inoperative.

The coatings C contain a suitable metal such as indium or an indium alloy which combines with a portion of the dosed mercury to form an amalgam within the finished fluorescent lamp 10. Due to their close proximity to the associated electrodes 20, the coated stripes C are rapidly heated when the lamp 10 is energized and thus release mercury vapor in sufficient amounts to permit the lamp to reach stabilized light output quickly. The stripes C accordingly function as auxiliary amalgam sources which provide the desired fast "warm-up" characteristic when the lamp is started in cold condition.

The coatings C are formed by dispersing powdered amalgamative metal such as indium in a suitable liquid vehicle to form a paint which is simply deposited on the selected portions of the stem press 15 by means of a brush or other applicator. The paint is then dried to form a thin adherent coating on the glass surface of the stem. This is done before the stem assemblies 14 are sealed to the ends of the envelope 12.

The adherence of the coatings C to the stem surface can be improved by adding finely-divided aluminum particles to the paint composition. The quantity of the powderized aluminum additive is not critical and amounts equivalent to about 10% to 60% by weight of the indium has provided satisfactory results. Other suitable metals (such as powdered tin, titanium and zirconium) or powdered non-metallic materials (such as aluminum oxide, magnesium oxide, titanium oxide, etc.) which will not contaminate the lamp may also be used.

As a specific example, good results have been obtained by coating the press seals 15 of both stem assemblies 14 of an amalgam-type 1500 milliampere fluorescent lamp approximately 244 cms. in length with a metallic paint composition consisting of 94 cc. of nitrocellulose lacquer, 46 cc. of "Cellosolve" acetate, 24 grams of aluminum powder (preferably in flake form) and 40 grams of indium powder. The paint was applied in the form of two elongated stripes (of the type shown in FIGS. 1 and 2) each of which were approximately 3 to 5 millimeters in width and extended to and covered the contiguous segments of the respective leads 16, 17 as well as the junction of the leads and the presses 15. This provided approximately 1.5 milligrams of indium powder on each of the stem assemblies 14.

Experience has shown that from 1 to 3 milligrams of indium powder in the conductive coatings C on each of the stem assemblies 14 are required to provide effective fast warm-up of the aforementioned 1500 ma. type lamp. The amount of auxiliary amalgamative metal will, of course, vary depending on the physical size and rating of the particular lamp. Thus, the composition of the paint and the area of the stem to which it is applied are both correlated with the size and electrical characteristics of the lamp to provide the proper amount of auxiliary amalgamatve metal on each of the stems.

The paint formulation described above forms a thin coating which, when dried, is semi-conductive (electrical resistance in excess of 20,000 ohms) and has a "silvery" finish. Its semi-conductive property apparently derives from the fact that "flake" aluminum powder is used and produces a laminar or "layered" effect in the coating. As the lamp 10 begins to fail due to the lack of emission material on the electrodes 20, the arc strikes the bar tungsten coil and lead wires 16, 17 and sputters metal onto the coatings C which quickly renders them electrically conductive so that they start to function as cold anodes and draw the arc to the stems 14.

As will be apparent, coatings of material that contain a suitable amalgamative metal and are electrically conductive as soon as applied to the stems and dried can also be used. However, care must be taken in this case to avoid applying it to parts of the stems or in amounts which would short-circuit the lead wires.

Figure 4:
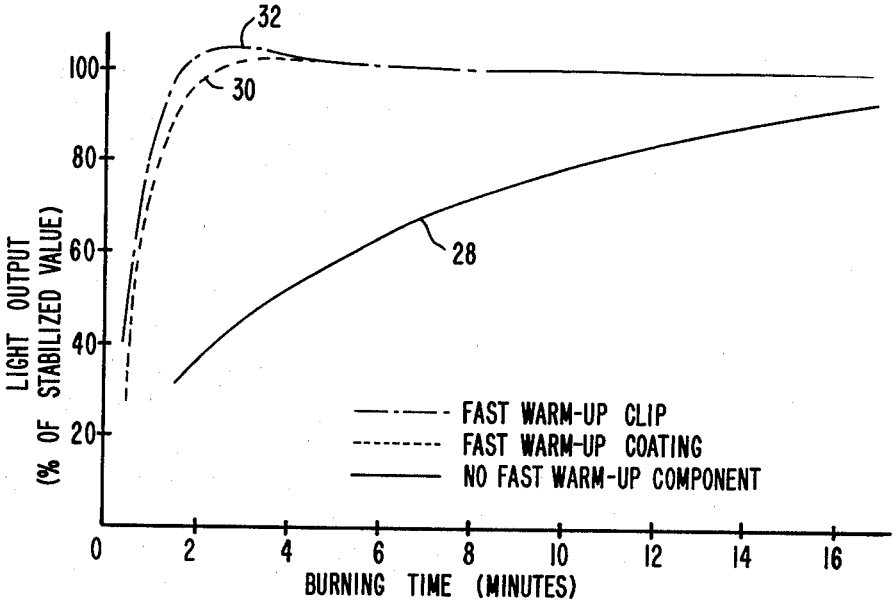
FIG. 4 is a graph illustrating the warm-up characteristics of the improved fluorescent lamp compared to those of a standared lamp which contains only a main amalgam component and a lamp that contains both a main amalgam component and an auxiliary amalgam source which is carried by a fail-safe metal clip pursuant to the teachings of the aforesaid U.S. Pat. No. 3,562,571.

Tests have shown that fluorescent lamps made in accordance with the invention failed safely as a result of damage to the glass stems induced by coatings C on selected areas of the press seals. Comparative lamp tests have shown that the invention also provides the desired "fast warm-up" feature under cold-start conditions. This is apparent from the light output-versus-stabilization curves depicted in FIG. 4 which were obtained by operating the lamps in still air at their rated voltage and amperage at room temperature (27° C). As shown by curve 28, a fluorescent lamp rated at 1500 milliamperes (244 cms. long) and having only a main amalgam component held in place on the tubular portion of the stem by a wire mesh collar as above described took approximately 4 minutes to reach 50% of its stabilized light output after it was energized, and reached only about 92% of its stabilized light output after 16 minutes burning.

In contrast, a lamp of identical construction, size and rating provided with two indium-containing coated stripes C on each of the stem presses pursuant to the invention reached approximately 97% of its stabilized light output after only 2 minutes of burning (as shown by curve 30), slightly exceeded 100% of its stabilized output after approximately 3 minutes burning and finally stabilized at 100% light output after only 6 minutes of burning time.

Curve 32 is the light output versus stabilization curve of an identical lamp provided with a fast warm-up "metal clip" of the type described in the Evans et al U.S. Pat. No. 3,562,571. As will be noted, the "metal clip" provided a slightly faster warm-up (100% of stabilized light output after only about 1½ minutes burning) compared to the amalgamative-metal coating of the present invention but stabilized the light output as its 100% value at practically the same time (6 minutes burning).

Figure 5:
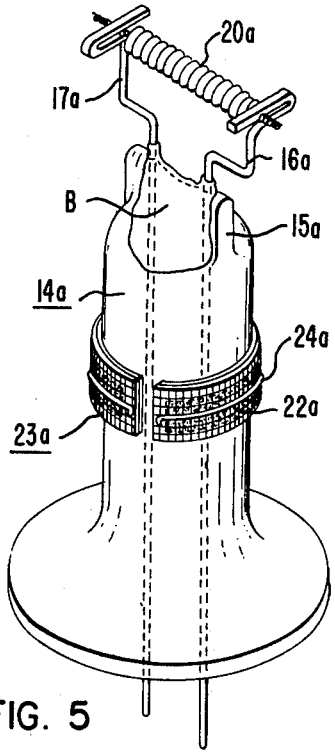
FIG. 5 is a perspective view of an alternative stem assembly.

While the coatings C of indium-containing paint have been illustrated and described as being applied to the same face of the stem press 15, this is not critical and the metal paint can be applied to alternate or both faces of the press seal, or to its side edges. Moreover, the coating of metallic paint does not have to be applied to the stems in the form of individual stripes but can be deposited over a wider area in the form of a band. An alternative stem embodiment **14*a* having such a band-like "fast warm-up" coating B is shown in FIG. 5. As illustrated, the coating B of amalgamative metal-containing material covers the entire medial portion of one of the faces of the press seal 15*a*. Hence, it overlies the embedded segments of both of the lead wires 16*a*, 17*a* and extends axially from the stem shoulder to the lip of the press seal 15 and up onto the contiguous parts of the respective lead wires. As in the case of the previously described embodiment, the illustrated stem assembly 14*a* is also provided with a wire-mesh collar assembly 23*a* that includes the main source of amalgam 22*a*** for regulating the vapor pressure within the operating lamp.

While indium and indium alloys have been specifically mentioned as the amalgamative metal in the dual-purpose coatings applied to the stem assemblies, it will be apparent to those skilled in the art that any suitable mercury-amalgamative metal can be employed (cadmium, gallium, gold, lead, tin, zinc and alloys thereof). Indium-tin alloys of suitable composition are disclosed in U.S. Pat. No. 3,526,806 of Evans et al.

I claim as my invention:

1. In a fluorescent lamp having a glass envelope that contains a pair of spaced electrodes which are coated with electron-emissive material, an ionizable medium that includes mercury, and a quantity of a mercury-amalgamative material which is disposed on an interior structural part of the lamp at a location remote from both of said electrodes such that said material constitutes a main mercury-amalgam source that controls the mercury-vapor pressure within the energized lamp under stabilized operating conditions, the improvement comprising the combination of;

a glass stem of hollow configuration sealed to and extending into said envelope, the inner end of said stem being closed by an hermetic seal, a pair of lead wires extending through the glass stem and said hermetic seal into the envelope, one of said electrodes being secured to the inner end portions of the lead wires that are located within the envelope, a coating of mercury-amalgamative metal on the inner end of said glass stem and extending along said hermetic seal onto a portion of at least one of said lead wires that is contiguous with the hermetic seal and is located within the envelope, and an additive in said coating which renders the coating semiconductive, as formed, and subsequently enables the coating to become conductive at the end of the useful life of the lamp when said coating is subjected to sputtered metal from the associated electrode and lead wires, said amalgamatve-metal coating being disposed on a segment of said stem that substantially overlies a part of said one lead wire that is embedded within the hermetic seal so that said coating, when rendered conductive at the end of the useful life of said lamp, provides an electrically-conductive path from the inner end portion of said one lead wire which is located within said envelope to the part thereof which is embedded within the hermetic seal and said coating thereby constitutes a dual-purpose component which serves as a fail-safe structure and an auxiliary mercury-amalgam source for said lamp.

2. The improvement of claim 1 wherein;

the mercury-amalgamative metal in said coating comprises a metal of the group consisting of indium, cadmium, gallium, gold, lead, tin, zinc and alloys thereof, the hermetic seal on the inner end of said stem comprises a press seal of fused glass that has two substantially oppositely-disposed faces, medial parts of said lead wires are embedded in the press seal, and said coating of amalgamative metal extends along the surface of at least one of the faces of said press seal.

3. The improvement of claim 2 wherein the amalgamative metal in said coating is indium or an indium alloy and said coating is of such configuration that it is disposed in spaced but overlying relationship with parts of both of said lead wires that are embedded in the press seal.

4. The improvement of claim 2 wherein said coating consists of two stripes that extend across a face of the press seal in spaced but overlying relationship with the embedded parts of the respective lead wires.

5. The improvement of claim 1 wherein the additive in said amalgamative-metal coating comprises finely-divided aluminum particles of flake configuration in an amount sufficient to render the coating semiconductive, as formed.

6. In a low-pressure type electric discharge lamp having a sealed light-transmitting envelope that contains spaced thermionic electrodes and an ionizable medium including mercury and has a re-entrant wall portion with an associated pair of lead-in conductors which are sealed through said wall portion and protrude therefrom into the envelope and are connected to one of said electrodes, integral means for rapidly providing mercury vapor within the lamp under cold-start conditions and, at the end of the useful life of said lamp, automatically initiating its failure in a safe manner, said means comprising an adherent coating which is disposed on the inner surface of the re-entrant wall portion of said envelope and contains (a) a metal that combines with some of the mercury within the lamp to form an amalgam, and (b) an additive which renders the coating semiconductive, as formed, said coating being located on a part of the re-entrant wall portion of said envelope that is proximate to a sealed-in segment of at least one of said lead-in conductors and is adjacent to the associated electrode, and said coating also extending into overlapping and contacting relationship with said one lead-in conductor at the point where it emerges from said re-entrant wall portion and thereby being adapted, when rendered conductive by sputtered metallic deposits from the associated electrode and lead-in conductors at the end of the useful life of the lamp, to then provide an electrically-conductive path along a predetermined part of said re-entrant wall portion.

7. The electric discharge lamp of claim 6 wherein;

said envelope is of elongated configuration, composed of vitreous material and closed at each end by a re-entrant wall portion consisting of a vitreous stem that is sealed to said envelope and has its innermost end terminated by an hermetic seal through which the respective lead-in conductors extend, each of said stems carry an additive-containing coating of mercury-amalgamative metal which extends along and beyond the hermetic seal, and the total amount of amalgamative metal in said coatings is so correlated with the respect to the physical size and electrical characteristics of said lamp that the formed amalgam releases a sufficient amount of mercury vapor under cold-start conditions to achieve at least 90% of the stabilized light output of the lamp within about 4 minutes after the lamp is energized.

* * * * *